United States Patent [19]

Castelli et al.

[11] 4,342,880

[45] Aug. 3, 1982

[54] ELECTRIC CABLE FOR MEDIUM VOLTAGE

[75] Inventors: Mario Castelli, Bergamo; Bruno Martini, Milan, both of Italy

[73] Assignee: Industrie Pirelli Societa per Azioni, Milan, Italy

[21] Appl. No.: 179,638

[22] Filed: Aug. 20, 1980

[30] Foreign Application Priority Data

Aug. 30, 1979 [IT] Italy ..... 25354 A/79

[51] Int. Cl.[3] ..... H01B 9/02

[52] U.S. Cl. ..... 174/36; 174/105 SC; 174/106 SC; 174/120 SC

[58] Field of Search ..... 174/120 SC, 120 AR, 174/102 SC, 105 SC, 106 SC, 110 AR, 36; 260/42.46

[56] References Cited

U.S. PATENT DOCUMENTS

| | | | |
|---|---|---|---|
| 2,446,387 | 8/1948 | Peterson | 174/105 SC |
| 2,471,752 | 5/1949 | Ingmanson | 174/120 AR |
| 3,645,958 | 2/1972 | Palumbo | 260/42.46 X |
| 3,862,056 | 1/1975 | Hartman | 260/42.46 |
| 3,885,085 | 5/1975 | Bahder | 174/120 AR X |
| 4,132,698 | 1/1979 | Gessler | 260/42.46 ZR |
| 4,226,823 | 10/1980 | Jansson | 174/120 SC X |

*Primary Examiner*—Richard R. Kucia

*Attorney, Agent, or Firm*—Brooks, Haidt, Haffner & Delahunty

[57] ABSTRACT

This invention refers to a medium voltage electric cable (up to about 45 kV) comprising one or more cores, each of said cores being constituted by a conductor covered with an inner semiconductive screen, an insulation layer of extruded polymeric material (preferably, cross-linked polyethylene or ethylenepropylene rubber) and an outer semiconductive screen.

The outer semiconductive screen, which is extruded on the insulation and vulcanized at the same time as the insulation in a continuous vulcanizing line, is constituted by a mixture based on a blend of nitrile rubber and ethylene-propylene rubber and containing carbon black, cross-linking agents and various additives.

The blend of nitrile rubber and ethylene-propylene rubber comprises 50–70 parts by weight of nitrile rubber and 50–30 parts by weight of ethylene-propylene rubber.

The so constituted outer semiconductive screen has good adhesion to the insulation and can be easily removed from said insulation.

7 Claims, 1 Drawing Figure

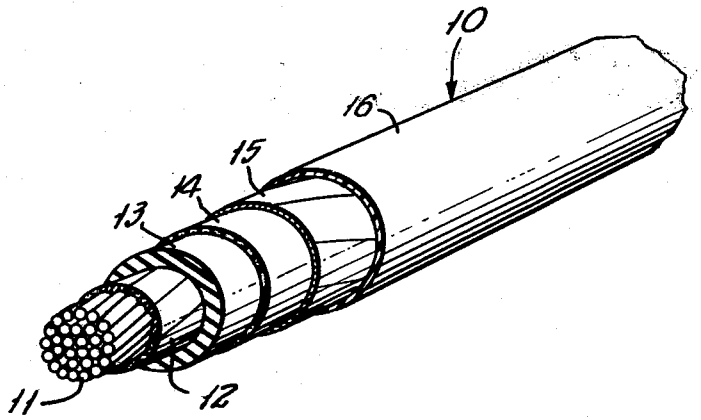
10
16
15
14
13
12
11

ELECTRIC CABLE FOR MEDIUM VOLTAGE

DESCRIPTION

The present invention refers to an improved electric cable for medium voltages (up to about 45 kV), comprising one or more cores laid up at least in a common protective covering.

Each core is constituted by a conductor covered with an inner semiconductive screen, by an insulation layer and an outer semiconductive screen, said core being improved so that said outer semiconductive screen is adherent to said insulation, but also is easily removable (or, as said in the art, "strippable") from the insulation itself.

The functions of said inner semiconductive screen, of said insulation and said outer semiconductive screen are known to those skilled in the art, as well as their different embodiments.

The inner semiconductive screen can be a semiconductive tape wound around the conductor or a material, containing carbon black and based on cross-linkable polymers or not, which is extruded on the conductor.

The insulation layer is obtained by an extruded polymeric material containing at least added cross-linking agents for the vulcanization; preferably, said insulation layer is based on cross-linked polyethylene (XLPE) or ethylene-propylene rubber (EPR).

The outer semiconductive screen is also constituted by a material based on cross-linkable polymers, which contains carbon black and cross-linking agents; said outer semiconductive screen is extruded on the insulation layer and is vulcanized at the same time as the latter is continuous vulcanizing lines.

The technique of extruding and vulcanizing the insulation at the same time as the outer semiconductive screen is that generally used.

Said technique has in fact great technical advantages among which, in particular, the possibility of obtaining a good adhesion of the outer semiconductive screen to the insulation and of avoiding entrapping of air and moisture in the contacting zone; this constitutes a guarantee against the risk of discharges and phenomena of ionization.

In this connection, it is to be remembered that a high adhesion between the insulation layer and the outer semiconductive screen is, on one hand, a positive element for the electrical characteristics of the cable, but on the other hand, a negative element for the removal (or strippability) of lengths of the outer semiconductive screen; this latter operation is required when accessories (joints, sealing ends, etc.) must be assembled on the cable or on its ends.

In the practice, different devices and processes have already been used to realize this operation easily and with safety, and in particular, without risks of damaging the underlying insulation.

Particular cutting systems for cutting the semiconductive screen are known which use tools provided with blades or which involve the incision of the outer semiconductive screen and heating (for example, with flames).

However, in any case an acceptable result, under every aspect, is achieved only in particular circumstances.

The cutting tools work well enough only if the insulation is of plastic material (for example XLPE), but not if the insulation is of elastomeric material (for example EPR); and this is for the simple reason that the blades cannot work with the necessary evenness and continuity when exerting a pressure on a deformable material, which compresses and expands according to the stress exerted against it.

By means of the cutting and heat-detaching systems, for example, with flames, a satisfactory result is achieved only if the outer semiconductive screen is based on an elastomeric material (for example EPR), that is, a material which does not lose its form with heat; on the contrary, this process cannot be applied with a semiconductive screen based on a cold, rigid material (for example XLPE), since this material loses its form, breaking into small pieces which are then hardly removable.

On the other hand, the use of flames is not advisable for safety reasons, and sometimes it is impossible for logistical reasons.

In order to avoid the above said drawbacks, i.e. the operating difficulties and the impossibility to operate with success in all cases, it is possible to follow a different procedure.

This procedure consists in choosing a material suitable for the outer semiconductive screen, which is a material which permits not only a sufficient adhesion of the outer semiconductive screen to the insulation, but also an easy removal.

In these terms, a good result has been achieved by by using, for the outer semiconductive screen, a synthetic polymeric material which is heat-degradable in the presence of peroxide compounds.

This solution, described in the Canadian Pat. No. 1,047,135, has the advantage of realizing, through a contemporaneous extrusion and vulcanization of the insulation and of the outer semiconductive screen, an outer semiconductive screen easily removable from the insulation without particular difficulties, using both an insulation of cross-linked plastic material (for example XLPE) and of vulcanized elastomeric material (for example EPR).

However, this solution, which solves efficaciously the chemical-physical problems connected to the adhesion and to the removal of the outer semiconductive screen, has technological difficulties in the extrusion step that precedes the vulcanizing step.

In fact, during said extrusion step, there is the risk that, if the operating conditions (especially as regards the temperature) are not properly optimized and not maintained constant, a part of the peroxide compounds gives rise, before the proper time, to the vulcanization, i.e. when the extrusion step is still being carried out. This could cause the formation of clots of "scorched" material in the extruded material and, consequently, a not perfect covering of the insulation by the outer semiconductive screen.

Therefore, even if, from a general point of view, the problem concerning the adhesion and the removal of the outer semiconductive screen with respect to the insulation can be positively solved, there is always the problem of working in rather critical conditions as regards the extrusion conditions and, in particular, the temperature.

Therefore, the present invention aims at overcoming the drawbacks and the difficulties of the known technique, that is, of obtaining a medium voltage cable in which the outer semiconductive screen of each conductor has a good adhesion and also an easy removal with respect to the insulation of the conductor itself, and moreover, that said outer semiconductive screen can be applied on the insulation by means of an extrusion process and contemporaneous vulcanization, the insulation being based both on a cross-linked plastic material and on a vulcanized elastomeric material, without being subjected to particular critical conditions.

Consequently, the object of the present invention is an improved medium voltage electric cable, comprising one or more cores, each of said cores being constituted by a conductor covered with an inner semiconductive screen, an insulation layer based on an extruded and vulcanized polymeric material and an outer semiconductive screen extruded on said insulation and vulcanized at the same time as said insulation, characterized by the fact that said outer semiconductive screen is constituted by a mixture based on a blend of nitrile rubber and ethylene-propylene rubber, said mixture comprising carbon black and cross-linking agents.

The single sheet of drawing shows, by way of non-limiting example, a practical emnbodiment of the improved medium voltage electric cable according to the present invention.

The single FIGURE of the drawing illustrates a single-core cable, i.e. comprising only a single core.

However, as already said, the present invention is suitably applied also to a multi-core cable, which comprises a plurality of cores laid up in a common protective covering.

With reference to the drawing, the single-core cable 10 comprises the conductor 11 covered in turn with the inner semiconductive screen 12, the insulation layer 13, the outer semiconductive screen 14, the metallic screen 15 and the protective sheath 16 of plastic material.

Said inner semiconductive screen 12 may be constituted by a tape of fabric material made semiconductive by the addition of carbon black or, preferably, by a material containing carbon black based on cross-linked, or not cross-linked, polymers, which is extruded on the conductor 11.

The insulation layer 13 is constituted by an extruded polymeric material having at least added cross-linking agents for the vulcanization, and preferably, said insulation is based on cross-linked polyethylene (XLPE) or ethylene-propylene rubber (EPR).

The outer semiconductive screen 14 is, according to the present invention, constituted by a mixture based on a blend of nitrile rubber and ethylene-propylene rubber, said mixture comprising semiconductive carbon black and cross-linking agents. Moreover, said mixture can have added thereto, according to the precise electrical and mechanical requirements of the cable, substances well-known in the art, such as antioxidizing agents, plasticizers, etc.

The mixture constituting the outer semiconductive screen 14, is extruded on said insulation layer 13 and vulcanized at the same time as this latter in a continuous vulcanizing line, so that, as already said, the entrapping of air and moisture between the layers in contact is avoided.

The present invention will be better understood by the description of the examples set forth in Table I, which refer to preferred embodiments of the outer semiconductive screen for a medium voltage electric cable.

The mixture constituting the outer semiconductive screen is based on a blend of a nitrile rubber and ethylene-propylene rubber. Said blend constitutes about half the weight of said mixture, the remaining part being constituted by various additives which are suitable for providing the necessary operating and stability characteristics to the polymeric material.

The nitrile rubber (acrylonitrile-butadiene copolymer) is of the type having a high quantity of acrylonitrile (at least 35% by weight) and can have different viscosities.

TABLE I

EXAMPLES OF CHEMICAL COMPOSITION OF THE OUTER SEMICONDUCTIVE SCREEN AND OF THE "STRIPPING STRENGTH" ON THE INSULATION.

| | A | B | C | D | E |
|---|---|---|---|---|---|
| Chemical composition (parts by weight) | | | | | |
| nitrile rubber (40 parts by weight of acrylonitrile, Mooney viscosity 80 at 100 ° C.) | 24 | 30 | — | 23 | 30 |
| nitrile rubber (40 parts by weight of acrylonitrile, Mooney viscosity 50 at 100° C.) | — | — | 32 | — | — |
| ethylene-propylene rubber (unsaturated, at least 60 parts by weight of ethylene) | — | 17 | 15 | — | — |
| ethylene-propylene rubber (unsaturated, about 50 parts by weight of ethylene) | 21.5 | — | — | 23.5 | — |
| ethylene-propylene rubber (saturated, about 50 parts by weight of ethylene) | — | — | — | — | 16 |
| chlorinated polyethylene (36 parts by weight of chlorine, Mooney viscosity about 110 at 100° C.) | — | 7 | 8 | — | 7 |
| polyethylene with "melt flow index" = 20 | 7 | — | — | 10.5 | — |
| semiconductive carbon black | 27 | 24 | 24 | 26 | 24 |
| calcium carbonate | — | 4.4 | 4.5 | — | 5.4 |
| kaolin | 8.4 | — | — | 4.9 | — |
| plasticizer based on organic aliphatic polyester (molecular weight lower than 2000) | 4 | — | — | 4 | — |
| plasticizer based on liquid nitrile rubber (33 parts by weight of acrylonitrile, viscosity lower than 30000 cpoise) | — | 8 | 5 | — | 8 |
| polyethylene glycol with melting point about 50° C. | — | 3 | 3 | — | 3 |
| stearic acid | 2 | — | — | 2 | — |
| ammine antioxidizing agent bis(tert.butylperoxy) di-isopropylbenzene | 2.1 | 2 | 1.9 | 2.1 | 2 |
| 2,5-dimethyl-2,5-di-(tert-butylperoxy)-esine-3 | 2 | — | 1.5 | 2 | — |
| minium | — | 1.5 | — | — | 1.5 |
| zinc oxide | — | 3.1 | 3.1 | — | 3.1 |
| Stripping strength (kg/cm) | | | | | |
| on insulation of XLPE | 7 | 2 | 4 | 8 | 2 |
| on insulation of EPR | 10 | 3 | 4 | 9 | 3 |

The ethylene-propylene rubber can be of the "unsaturated" terpolymer type (i.e., as it is known, resulting from the polymerization of a mixture of ethylene and propylene containing also small quantities of a diene) or "saturated" (i.e. without diene). In any case the content of ethylene is not lower than 50% by weight.

In the blend of nitrile rubber and ethylene-propylene rubber, that characterizes the composition of the outer semiconductive screen according to the invention, the ratio between the two rubber types can vary from about 50/50 parts by weight (example D) to about 70/30 parts by weight (example C) and, preferably, is about 65/35 parts by weight (examples B and E).

A certain quantity of chlorinated polyethylene can be added to the nitrile rubber and ethylene-propylene rubber (examples B, C and E) to improve the compatibility of the two rubbers. Said chlorinated polyethylene has also an advantageous effect with respect to the adhesion characteristics in respect of the insulation.

The quantity of chlorinated polyethylene is, in any case, lower or equal to 10 parts by weight on the total quantity of the mixture, i.e. about 20 parts by weight on the blend of nitrile rubber and ethylene-propylene rubber.

The mixture constituting the outer semiconductive screen is obtained by adding to the blend of nitrile rubber and ethylene-propylene rubber, semiconductive carbon black, cross-linking agents (generally organic peroxides) and other products, known in the art, to satisfy in each case the operating and stability requirements of the mixture (plasticizers, mineral fillers, antioxidizing agents, etc.).

The outer semiconductive screen is extruded on the insulation and subjected to vulcanization at the same time as said insulation in a continuous vulcanizing line.

Only by way of example, the vulcanizing conditions of the cables, for the case of a continuous line with saturated steam and as regards the mixtures of the type indicated in the examples of Table I, are the following: 200° C. of temperature, 15 atm of pressure, 20 minutes of time.

Of course, these conditions can be fitted to the specific characteristics of every cable.

In Table I there are also the values of the "stripping strength" on two different types of medium voltage insulation: the cross-linked polyethylene (XLPE) and the vulcanized ethylene-propylene rubber (EPR).

Said "stripping strength" is measured according to the standards AEIC CS 6-79, section D, 1÷3 indicated in the "Specifications for Ethylene-Propylene Insulated Shielded Power Cables Rated 5 to 69 kV". Said standards determine limit values between 1.8 kg/cm (4 pounds) and 12.6 kg/cm (28 pounds) to remove from the insulation a strip of the outer semiconductive material with width of 1.27 cm (½ inch).

From Table I it is apparent that the minimum values of the "stripping strength" are obtained in examples B and E, both for a cable having an XLPE insulation and for a cable having an EPR insulation. In said examples, the mixture of the blend of nitrile rubber and ethylene-propylene rubber is about 63/35 parts by weight.

Also it is clear that in all the examples set forth in Table I, both on XLPE insulations and EPR insulations, values of the "stripping strength" in accordance with the above said standards and also lower than those achieved with the known techniques, are obtained.

The most substantial advantage of the present invention with respect to the known technique consists in the fact that the mixture constituting the outer semiconductive screen can be worked in the step of extrusion within a good range of temperature, without risk of producing, as a result of alterations of the optimism values of the temperature, clots of "scorched" material in the extruded material, and therefore, the working condition is very good.

Although only some preferred embodiments of the outer semiconductive screen according to the present invention have been described, it is understood that the invention includes in its scope any other alternative embodiment within the skill of a technician in the field.

We claim:

1. A medium voltage electric cable having at least one conductor, each conductor being covered by an inner semiconductive screen in contact therewith, a layer of extruded, cross-linked polymeric insulation around said inner screen, and a readily peelable outer semiconductive screen around said layer of insulation and adhering thereto, said outer semiconductive screen being a chemically cross-linked rubber comprising a cross-linked blend of 50–70 parts by weight of nitrile rubber and 50–30 parts by weight of ethylene-propylene rubber, carbon black and cross-linking agents, said blend constituting at least about one-half by weight of the material of said outer screen.

2. A cable as set forth in claim 1 wherein said blend contains 65 parts by weight of nitrile rubber and 35 parts by weight of ethylene-propylene rubber.

3. A cable as set forth in claim 1 or 2 wherein said nitrile rubber is a butadiene-acrylonitrile copolymer comprising at least 35 parts by weight of acrylonitrile.

4. A cable as set forth in claim 3 wherein the material of said outer screen comprises chlorinated polyethylene.

5. A cable as set forth in claim 4 wherein the material of said outer screen comprises no greater than 10 parts by weight of chlorinated polyethylene per 100 parts by weight of the outer screen material.

6. A cable as set forth on claim 1 or 2 wherein the material of said outer screen comprises chlorinated polyethylene.

7. A cable as set forth in claim 6 wherein the material of said outer screen comprises no greater than 10 parts by weight of chlorinated polyethylene per 100 parts by weight of the outer screen material.

* * * * *